United States Patent [19]

Junkers

[11] 4,239,514

[45] Dec. 16, 1980

[54] ELECTROSTATIC PRECIPITATOR WITH PRECIPITATOR ELECTRODES

[75] Inventor: Gerd Junkers, Bad Homburg, Fed. Rep. of Germany

[73] Assignee: Saarbergwerke Aktiengesellschaft, Saarbrücken, Fed. Rep. of Germany

[21] Appl. No.: 887,301

[22] Filed: Mar. 16, 1978

[30] Foreign Application Priority Data

Mar. 18, 1978 [DE] Fed. Rep. of Germany ..... 2711858

[51] Int. Cl.[3] ..... B03C 3/08; B03C 3/47

[52] U.S. Cl. ..... 55/145; 55/156

[58] Field of Search ..... 55/130, 141, 143, 145, 55/147, 156, 154, 112, 113, 149

[56] References Cited

U.S. PATENT DOCUMENTS

| | | | |
|---|---|---|---|
| 2,852,093 | 9/1958 | Streuber | 55/141 |
| 3,372,529 | 3/1968 | Harms | 55/145 |
| 4,007,023 | 2/1977 | Bätza et al. | 55/143 |

FOREIGN PATENT DOCUMENTS

| | | | |
|---|---|---|---|
| 707103 | 4/1954 | United Kingdom | 55/145 |
| 1099342 | 1/1968 | United Kingdom | 55/112 |

*Primary Examiner*—David L. Lacey

*Attorney, Agent, or Firm*—Peter K. Kontler

[57] ABSTRACT

The invention relates to an electrostatic precipitator with collecting electrodes which are arranged in rows adjacent to each other and in respective pairs at equal distances from a respective discharge electrode with which they cooperate. Spring elements are provided between the collecting electrodes and influence the stiffness and oscillating properties of the array of the collecting electrodes.

17 Claims, 7 Drawing Figures

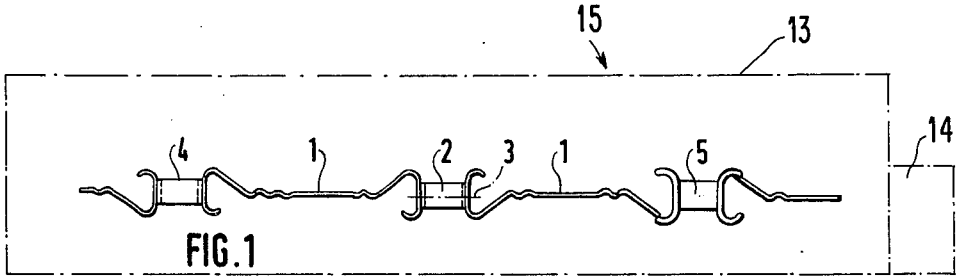
FIG. 1
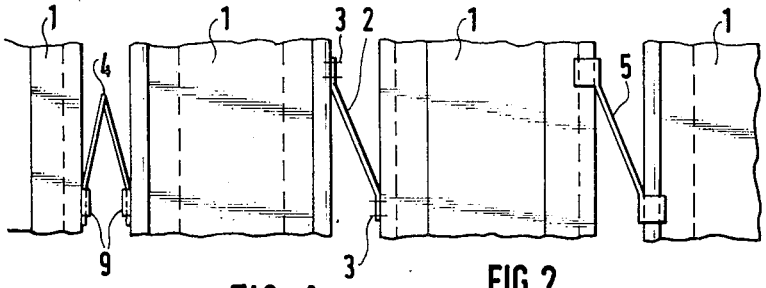
FIG. 4a
FIG. 2
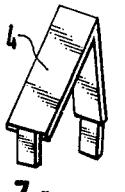
FIG. 3a
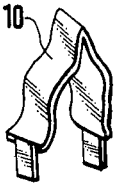
FIG. 3b
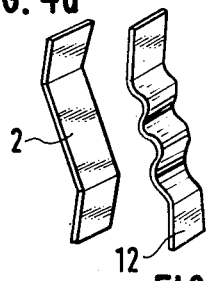
FIG. 4b
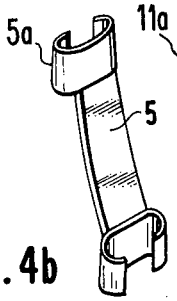
FIG. 5a
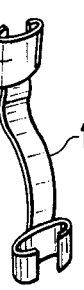
FIG. 5b
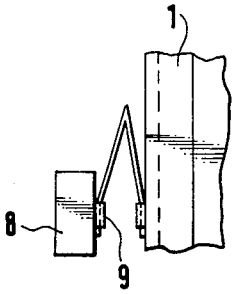
FIG. 6
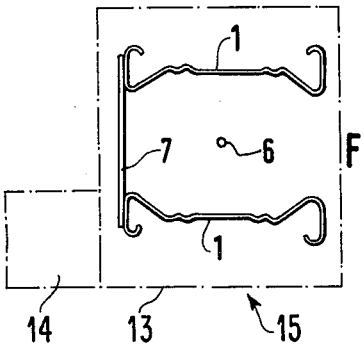
FIG. 7

ELECTROSTATIC PRECIPITATOR WITH PRECIPITATOR ELECTRODES

BACKGROUND OF THE INVENTION (1) Field of the Invention

The invention relates to an electrostatic precipitator with a number of collecting electrodes which are arranged in rows adjacent to each other and in respective pairs at equal distances from a respective discharge electrode (for instance wire) with which they are opposite.

(2) The prior art

Electrostatic precipitators are commonly used to precipitate dust from waste gas or expelled air from a dust producing plant such as mixing and grinding plant, sintering plant, power station etc. In order to be able to fulfil the requirements of anti-air pollution legislation, which have been made more and more stringent in the last two decades, it has become necessary to construct substantially larger electrostatic precipitators with collecting or precipitator electrodes each having a length of up to 14 meters. This length gives rise to various problems.

On the one hand, long precipitator electrodes must have sufficient mechanical strength and resistance to twisting; they are therefore usually provided with longitudinal corrugations and are crimped at their edges. They are mounted in a suspended array in the precipitator, being arranged in rows and connected at their upper and lower ends such as, for example, by a yoke or retainer made of two pieces of flat iron.

On the other hand, it is necessary to assure that the sheet metal precipitator electrodes can oscillate at their resonance frequency so that they can be rid of adhering dust by being subjected to rapping. The thickness of the sheet metal therefore should not exceed approximately 2.5 mm in order to ensure a sufficiently large amplitude of oscillation following an impact of a hammer weight which is appropriate for performing the dust-dislodging operation.

In previously proposed electrostatic precipitators, the precipitator electrodes have a relatively low mechanical strength: they have a substantial length and a low sheet metal thickness. In consequence, low frequency transverse and twisting oscillations occur in the precipitator electrodes, which are caused by the gas current flowing through the arrangement and can reach resonance levels. (In this respect, however, the resonance occurs at a very much lower frequency than the above mentioned resonance due to rapping). The consequence of this is that, owing to the reduction in the distances between the discharge electrodes and the precipitator electrodes, the amount of sparking increases and, as a result, the operational voltage is automatically reduced, which brings about a reduction in the precipitation output.

Attempts have already been made to provide a yoke-like retainer-like stiffening member halfway along the length of long precipitator electrodes in order to avoid the low frequency transverse and torsional oscillations. Furthermore, attempts have been made to arrange screw means and holding iron elements halfway along the length or to provide holding guide cords.

The disadvantage of these known solutions is that they, on the one hand promote local sparking that results in reduction in the operating voltage while, on the other hand substantial frictional wear occurs in contact zones under the action of the solid particles to be precipitated and the movement of the precipitator electrodes following the rapping. As a result, the discharge electrodes are damaged at certain regions by spark erosion and, furthermore, the thin precipitator electrodes are abraded and fractured. The frictional wear of the precipitator electrodes is furthermore augmented by spark erosion when the potentials are different. The efficiency and service life of the electrostatic precipitator are reduced as a result.

OBJECTS AND SUMMARY OF THE INVENTION

One object of the present invention is to avoid these disadvantages and provide an electrostatic precipitator of the initially mentioned type, whose precipitator electrodes have sufficient mechanical strength and are not damaged by abrasion.

In order to achieve this and other objects in accordance with the invention spring elements are provided between any two precipitator electrodes arranged adjacent to each other. The stiffness and oscillating properties of the array of long precipitator electrodes is influenced by these spring elements, due to their mechanical properties.

In accordance with a preferred form of the invention, the spring elements are made of spring strips in the form of flat steel so that the forces to which the gas current subjects the precipitator electrodes are counteracted (in addition to the damping force of the precipitator electrodes which alone is not sufficient owing to low degree of mechanical stiffness) by a sufficient damping force applied by the spring strips and no resonnance oscillations in the low frequency range, that is undesired so-called fluttering movements, can occur.

The attachment of the spring strips to the precipitator electrodes is by means of a force-fit connection preferably using a known expedient such as a screw, spot weld, rivet, clip or plug-in connection.

An advantage of the construction and attachment of the spring strips between adjacent precipitator electrodes is that the spring strips only apply forces opposing twisting of the precipitator electrode out of its central position; in this manner the inherent oscillations, which are excited by rapping the precipitator electrodes, are not impeded or suppressed.

When the precipitator electrodes are rapped at their lower ends a small-scale pendular movement of the electrodes may occur in the direction of the row. Consequently, small vertical shift takes place between two points at the edges of adjacent precipitator electrodes. The extent of this vertical shift, primarily depends on the oscillating amplitude and the width of the electrode. Where this pendular movement can occur, in order to compensate for this extremely small vertical displacement of the two connection points of the spring strips, the latter are so constructed as to provide a suitable possibility of compensation, in the longitudinal direction, this may include an S or corrugated construction of the spring strip.

Such spring strips arranged with force-fit joints between the precipitator electrodes offer the advantage of ensuring that mutual hindrance of the precipitator electrodes cannot occur with respect to their movement in the row direction upon rapping the same.

The force fit connection between the spring strips and the precipitator electrodes also guarantees a good electrical connection and therefore potential equalization between the precipitator electrodes.

The spring strips can be advantageously arranged at any desired level or height of the precipitator electrodes; any desired number of spring strips can be distributed along the length of the precipitator electrodes. In this manner thinner material can be used for the precipitator electrodes and the material can be more economically used.

The invention will now be described with reference to some embodiments shown by way of example only.

BRIEF DESCRIPTION OF THE DRAWING

FIG. 1 is a top plan view of a row of precipitator electrodes installed in a diagrammatically indicated electrostatic precipitator, FIG. 2 is a lateral view of the row of precipitator electrodes;

FIGS. 3*a* and 3*b* are perspective views of two plug-in type spring strips;

FIGS. 4*a* and 4*b* are perspective views of two other types of spring strips suitable for riveting, screwing or spot welding in place;

FIGS. 5*a* and 5*b* are perspective views of two additional types of springs strips with clip joints;

FIG. 6 is a side elevational view of a precipitator electrode fixed to an auxiliary frame;

FIG. 7 is a top plan view of two opposite precipitator electrodes connected together by a spring strip and installed in a diagrammatically indicated electrostatic precipitator.

DESCRIPTION OF PREFERRED EMBODIMENTS

In FIG. 1, reference numeral 1 denotes precipitator electrodes, whose grooved shape and crimped edges for mechanical stiffening will be readily apparent. These precipitator electrodes 1 are equally spaced from a discharge electrode or wire 6 (FIG. 7) in a paired fashion in long opposite rows. All precipitator electrodes 1 are at the same potential. The electrodes 1 and 6 are mounted, in a conventional manner, in a housing 13 which is indicated in FIGS. 1 and 7 merely in phantom lines. They constitute, together with electric circuitry of conventional design which is diagrammatically indicated at 14, a precipitator 15. In order to ensure that the high voltage between the discharge electrodes 6 and the precipitator electrodes 1 can be as large as possible, low frequency twisting and transverse oscillations must be avoided in the sheet metal of the precipitator or collecting electrodes 1, which has a maximum thickness of 2.5 mm. Such oscillations would briefly reduce the clearance between the electrodes 1 and 6 and accordingly reduce the voltage at which sparking would occur. On the other hand, oscillations in the resonance range of precipitator electrodes 1 following rapping are not to be damped.

This is ensured by the use of spring 2, 4, 5, 10, 11 or 12, which are so designed and arranged that they have a pronounced resiliency only in one specific direction and are mechanically stiffer and more resistant to torsion in the other directions. In accordance with one embodiment, spring strips 2, 4 and 5 have been found suitable. They are illustrated in detail in FIGS. 3*a*, 4*a* and 5*a*. The straight part of the spring strips when necessary, can be provided with suitable compensation means, such as a corrugated or S-construction as shown in the strip springs 10, 12, 11 of FIGS. 3*b*, 4*b* and 5*b*, for the purpose of compensation or equalization of vertical displacements of the attachment points owing to pendular movements of the precipitator electrodes 1.

The precipitator electrodes 1, only fragments of which are shown in FIG. 2, generally have a length of up to 14 m and thus are capable of oscillating at a low frequency on excitation by the gas flow, in dependence on the dimensions.

In order to prevent or suppress these low frequency oscillations, as shown in FIG. 2, adjacent precipitator electrodes 1 are connected by the strip springs 2, 4 and 5 rigidly connected to their crimped edges.

FIG. 2 shows an embodiment in which all spring strips 2, 4 and 5 are used simultaneously, for illustrative purposes. In each specific application, only one type of spring strip 2, 4, 5, 10, 11, or 12 is employed, for example the spring strip 2 which is slightly angled twice, having a screw connection 3, a rivet connection or a spot weld connection, or the spring strip 5 with its tongs-like configuration and clip connection 9, these forms being particularly suitable for employment in pre-existing electrostatic precipitators. In a similar manner it is also possible to use the corrugated or S-shaped spring strips 10, 11 and 12 (FIGS. 3*b*–5*b*).

For the construction of a new electrostatic precipitator unit 15 the spring strip 5 or 11 respectively with a plug connector 5*a* or 11*a* is particularly suitable. The precipitator electrodes 1 are provided during manufacture at regular spacings at their crimped edges with female pockets 9 (FIG. 2) by slotting and pressing. On assembly, the spring strips 4 and 10 (FIGS. 3*a*, 3*b*) are then inserted into the female pockets 9, the desired number thereof being distributed over the length of the precipitator electrodes 1.

For stabilization of the first and the last precipitator electrode 1 of each row at a desired height auxiliary supports 8 are provided as shown in FIG. 6. They extend past the rows and are provided with female pockets 9. The first and the last precipitator electrode 1 of a row can be attached to the auxiliary support 8 by means of a spring strip 4 or 10 respectively inserted into the respective pockets 9. In lieu of the spring strips 4 shown by way of example, those of the embodiment 2 and 5 can be used with a simultaneous adoption of a suitable construction of the auxiliary support 8.

The flexible spring strips 2, 4, 5, 10, 11 and 12 which can only be bent in one direction without encountering a large counterforce, suppress, owing to their geometrically given stiffness in other directions, on the one hand, transverse and twisting oscillations of the precipitator electrodes 1 and, on the other hand, in the event of a suitable construction of the spring elements 10, 11 and 12 in accordance with FIGS. 3*a*–5*a* there is no mutual hindrance of the precipitator electrodes 1 on movement in the direction of the row when the electrodes 1 are rapped.

The spring strips 2, 4, 5, 10, 11 and 12 provided at the upper and lower ends of the precipitator electrodes 1 can also replace positive guide means previously necessary for preventing torsion movements.

Spring strips 7 (FIG. 7) can in some cases also be provided as transverse support means between two mutually opposite precipitator electrodes 1 so that the latter are spaced apart from the discharge electrode 6, the resistance to deformation and twisting is increased and the movement of the precipitator electrodes 1 in the direction of the row upon rapping is not impeded.

The connection of adjacent or oppositely placed precipitator electrodes 1 with spring 2, 4, 5, 7, 10, 11, or 12 strips accordingly increases the mechanical stiffness and damping properties at low frequency without impeding the necessary impact-dislodging operation. Furthermore equalization of potential is ensured. Wear of the spring strips 2, 4, 5, 10, 11 and 12 by solid particles and by the effect of an electric field and the production of local sparking are avoided, because they do not have any projecting edges and corners and are arranged in the flow shadows of, that is, they are shielded by, the crimped edges of the precipitator electrodes 1. Owing to the force-fit joint between the precipitator electrodes 1 and the spring strips 2 or 12 no frictional wear can occur. Furthermore, it is possible to use a thinner material for the precipitator electrodes.

The invention is not limited to the embodiments shown and instead can be used with other embodiments of spring elements.

What is claimed is:

1. An electrostatic precipitator comprising a number of precipitator electrodes; a number of discharge electrodes; and means for supporting said precipitator electrodes in rows adjacent to one another and in pairs opposite each other and said discharge electrodes at equal distances from the precipitator electrodes of the respective pairs, and said support means including spring elements interposed between said precipitator electrodes, each of said spring elements being connected to two adjacent precipitator electrodes of the same row.

2. An electrostatic precipitator comprising a number of precipitator electrodes; a number of discharge electrodes; means for supporting said precipitator electrodes in rows adjacent to one another and in pairs opposite each other and said discharge electrodes at equal distances from the precipitator electrodes of the respective pairs, and said support means including spring elements interposed between said precipitator electrodes; an auxiliary support; and at least one auxiliary spring element similar to said spring elements and interposed between and connected to said auxiliary support and one of the said precipitator electrodes.

3. An electrostatic precipitator comprising a number of precipitator electrodes; a number of discharge electrodes; and means for supporting said precipitator electrodes in rows adjacent to one another and in pairs opposite each other and said discharge electrodes at equal distances from the precipitator electrodes of the respective pairs, and said support means including spring elements interposed between and connected to said precipitator electrodes.

4. An electrostatic precipitator in accordance with claim 3 wherein at least one of the spring elements is interposed between and connected to two mutually opposite precipitator electrodes constituting the respective pair.

5. An electrostatic precipitator in accordance with claim 3 wherein each precipitator electrode has two longitudinally crimped edges; and wherein one end of each spring element is mechanically rigidly connected to the crimped edge.

6. An electrostatic precipitator in accordance with claim 3 wherein said spring elements are so constructed as not to produce any substantial force only in one direction and to be resistant to bending and torsion in other directions.

7. An electrostatic precipitator in accordance with claim 3 wherein said spring elements are electrically conductive to also establish an electrical connection between the precipitator electrodes.

8. An electrostatic precipitator in accordance with claim 3 wherein the spring elements are so arranged that the axis of transmission of the spring force of each spring element extends perpendicularly to the direction of the row of the precipitator electrodes.

9. An electrostatic precipitator in accordance with claim 3, wherein at least one of the spring elements is constructed as a spring strip of flat steel.

10. An electrostatic precipitator in accordance with claim 9, wherein the spring strip includes two end portions which are slightly angled with respect to the remainder of the spring strip and are parallel to the outer edges of the precipitator electrodes.

11. An electrostatic precipitator in accordance with claim 9, wherein the spring strip is V-shaped and has two spring strip ends which are slightly angled relative to the adjacent portions and extend parallel to the outer edges of the precipitator electrodes.

12. An electrostatic precipitator in accordance with claim 11, wherein the respective spring element has tongues at its ends which are somewhat narrower than the remainder of the spring element; and wherein the precipitator electrodes include female pockets, in which the tongues can be inserted with a force-fit.

13. An electrostatic precipitator in accordance with claim 9, wherein the spring strip is corrugated intermediate its ends for compensation of possible vertical displacements of attachment points at the precipitator electrodes.

14. An electrostatic precipitator in accordance with claim 9, wherein the respective end of the spring strip is rigidly connected with the outer edge of the precipitator electrode by a permanent connection.

15. An electrostatic precipitator in accordance with claim 9, wherein a tongs-like clip is provided at each end of the respective spring element by means of which the latter can be clamped at the outer edge of the precipitator electrode.

16. An electrostatic precipitator in accordance with claim 9, wherein the spring elements are so constructed and arranged as to augment the stiffness and the damping properties of the precipitator electrodes in a low frequency range.

17. An electrostatic precipitator in accordance with claim 16, wherein at least one of said spring elements is connected to two of said precipitator electrodes intermediate and at a distance from the ends of the latter.

* * * * *

UNITED STATES PATENT AND TRADEMARK OFFICE

CERTIFICATE OF CORRECTION

PATENT NO. : 4,239,514

DATED : December 16, 1980

INVENTOR(S) : Gerd JUNKERS

It is certified that error appears in the above-identified patent and that said Letters Patent are hereby corrected as shown below:

Foremost page, Item 75, "Bad Homburg" should read --Homburg--.

Signed and Sealed this

*Sixteenth* Day of *June 1981*

[SEAL]

*Attest:*

RENE D. TEGTMEYER

*Attesting Officer*

*Acting Commissioner of Patents and Trademarks*